United States Patent [19]

Brimhall

[11] 4,285,641

[45] Aug. 25, 1981

[54] HYDRAULIC PUMP AND VALVE

[76] Inventor: Randall L. Brimhall, 6918 Rhonda Ave., West Jordan, Utah 84084

[21] Appl. No.: 61,482

[22] Filed: Jul. 27, 1979

[51] Int. Cl.[3] ..... F04B 21/00; F04B 39/00

[52] U.S. Cl. ..... 417/442; 60/472; 60/477; 137/625.23

[58] Field of Search ..... 60/477, 471, 472, 476, 60/493, DIG. 10; 137/625.23, 625.24; 417/544, 442

[56] References Cited

U.S. PATENT DOCUMENTS

| | | | |
|---|---|---|---|
| 2,404,502 | 7/1946 | Kehle | 417/554 X |
| 2,961,003 | 11/1960 | Shafer et al. | 417/315 X |
| 3,370,421 | 2/1968 | Piper | 60/472 |
| 3,430,653 | 3/1969 | Brimhall | 137/625.23 |
| 3,610,283 | 10/1971 | Hill et al. | 137/625.23 |
| 3,824,043 | 7/1974 | Nordell | 417/568 X |

*Primary Examiner*—Irwin C. Cohen

*Attorney, Agent, or Firm*—Terry M. Crellin; B. Deon Criddle

[57] ABSTRACT

A hydraulic pump and valve unit is disclosed which is particularly useful in a system using a hydraulic cylinder for raising and lowering the cab of a truck. The unit includes a pump which is connected to a valve intake chamber which, in turn, opens axially into a flat end of a larger valve chamber. An annular thrust seal is slidably mounted in the valve intake chamber, and spring means biases the thrust seal against the flat end of a valve spool which is rotatably mounted in the valve chamber. The valve spool has a pair of flow passages therein which connect respective ports in the flat end of the valve spool with corresponding ports in the cylindrical surface of the valve spool. The ports in the cylindrical surface of the valve spool register with a second pair of cooperating flow passages which deliver hydraulic fluid under pressure from the unit to a system such as a hydraulic cylinder, and return hydraulic fluid from such system to the unit. The ports in the flat end of the valve spool are adapted to make mutually alternating registry with the opening from the valve intake chamber. A return flow passageway extends from an opening in the end of the valve chamber to a reservoir for hydraulic fluid, and the ports in the flat end of the valve spool are adapted so that when one port is in register with the opening from the valve intake chamber, the other port is in register with the opening to the return flow passageway.

5 Claims, 9 Drawing Figures

HYDRAULIC PUMP AND VALVE

BACKGROUND OF THE INVENTION

1. Field

The invention relates to pump and valve units used in supplying and controlling flow of hydraulic fluid to a hydraulically activated system. In particular the invention relates to a pump and valve unit suitable for controlling forward and reverse flows of hydraulic fluid to and from a hydraulic cylinder such as is commonly employed in raising and lowering a truck cab from its chassis.

2. State of the Art

Various four-way valves have been proposed heretofore for use in hydraulic systems such as those used in raising and lowering the cabs of large tractor-type trucks. As disclosed in U.S. Pat. Nos. 3,430,653 and 3,610,283, the valves comprise elongate, apertured valve spools rotatively mounted in valve bodies, wherein cooperative flow passages are provided in the valve spools and valve bodies for selective register by rotation of the valve spool. The valves are separate units, usually being located remote from the hydraulic pump. In U.S. Pat. No. 3,824,043, a pump and valve unit is provided wherein the pump portion and the valve portion are closely coupled in fluid flow communication by a common flow passage extending therebetween. In all of these units, especially the latter, the valve components are intricately shaped and require substantial machining.

3. Objectives

A principal objective of the present invention is to provide a compact pump and valve unit, with the pump chamber, the valve chamber, and associated flow passages being formed in a unitary body by simple machinery techniques. An additional objective is to provide a simple valve unit in which the valve spool requires minimum machining and improved sealing is achieved between the passages in the valve spool and in the valve body wherein essentially no leakage or flow loss occurs.

SUMMARY OF THE INVENTION

The above objectives are achieved in accordance with the present invention by providing a pump and valve unit in which the pump cylinder or chamber, the valve chamber, and associated passages are formed in a unitary block of material by simple machining techniques. A piston is adapted for reciprocal movement in the cylinder so as to form a pump chamber between the piston and one end of the pump cylinder. The pump chamber is, in turn, connected to a hydraulic fluid reservoir by a first flow passage. The reservoir is advantageously formed adjacent one side of the block of material, with the side of the block of material functioning as one of the ends of the reservoir. The first flow passageway is then readily formed by drilling a bore extending from the side of the block of material to pump cylinder.

A second flow passageway connects the pump chamber to a substantially hollow, cylindrical valve intake chamber. Check valve means are provided in both the first and second passageway to prevent backflow of hydraulic fluid through either passageway. A cylindrical thrust seal having a substantially axial bore hole extending therethrough is slidably mounted in the valve intake chamber, with a substantially absolute fluid-tight seal being made between the outer cylindrical wall of the thrust seal and the cylindrical lateral wall of the valve intake chamber. One end of the valve intake chamber opens substantially axially into a larger cylindrical valve chamber through a substantially flat end thereof with the cylindrical axis of the valve intake chamber being substantially parallel and offset from the cylindrical axis of the larger valve chamber. The valve chamber is formed by drilling a bore hole inwardly from the side of the body of material so that the internal end of the bore hole is substantially flat. The valve intake chamber is formed by drilling a bore hole, whose diameter is smaller than the diameter of the bore hole forming the valve chamber, inwardly from the flat end of the valve chamber, and the passageway between the valve intake chamber and the pump cylinder is formed by drilling a bore hole, whose diameter is smaller than the diameter of the bore hole forming the valve intake chamber, inwardly from the inner end of the valve intake chamber to the pump cylinder.

A hydraulic fluid return passage opens into the flat end of the valve chamber and extends to the hydraulic fluid reservoir. The openings from the return passage and the valve intake chamber, respectively, are equidistantly spaced in diametrically opposite directions from the center of the flat end of the valve chamber. The return passage is provided with means such as a metering orifice or the return passage is of a limited size so as to meter or otherwise limit the rate of fluid return to the reservoir.

A cylindrically-shaped valve spool is rotatably mounted in the valve chamber, with one end thereof being essentially flat and adapted to abut the flat end of the valve chamber for sliding circular motion with respect thereto. A pair of flow passages are provided in the valve spool having mutually respective ports in the flat end of the valve spool. The ports are disposed equidistantly in diametrically opposite directions from the cylindrical axis of the spool, so that they can be brought into mutually alternating register with the mutually respective openings in the flat end of the valve chamber by rotation of the valve spool. The flow passages in the valve spool extend from the respective ports in the end of the valve spool to respective openings spaced longitudinally from each other in the cylindrical surface of the valve spool.

A pair of cooperative flow passages having respective, longitudinally spaced openings in the cylindrical wall of the valve chamber are adapted to register with the respective openings in the cylindrical surface of the valve spool. With the valve spool in the first of its two operative positions, hydraulic fluid flows from the unit through the first of the latter passages and returns to the unit through the second. The flow of hydraulic fluid in these two passages is reversed, i.e., fluid flows from the unit through the second passage and returns to the unit through the first, when the valve spool is rotated to its second operative position.

Spring means are provided in the valve intake chamber biasing the cylindrical thrust seal against the flat end of the valve spool to make a sliding, fluid tight seal therebetween. The thrust seal-spring means has been found to be very effective in providing sealing pressure against the thrust seal during periods in the operation thereof when the fluid in the valve intake chamber is relatively low, such as when pressure is not being maintained in the system. As pressure is generated in the valve intake chamber, such pressure is also applied to the cylindrical thrust seal. The valve system in general is simple, easily operated, readily manufactured, durable, and carefree in operation.

THE DRAWINGS

A preferred embodiment of the pump and valve system of this invention representing the best mode presently contemplated of carrying out the invention in actual practice is illustrated in the accompanying drawings, in which.

DETAILED DESCRIPTION OF THE PREFERRED EMBODIMENTS

Figure 1:
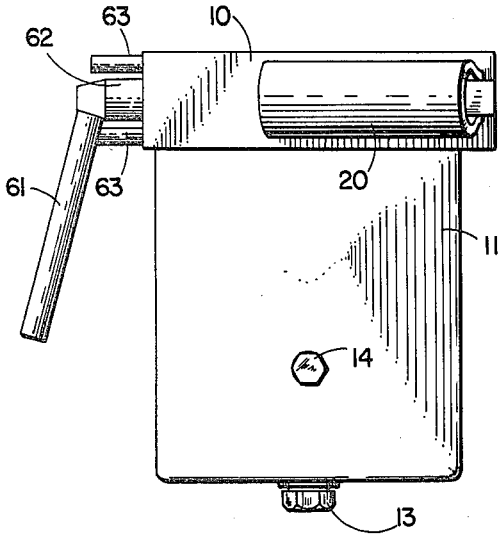
FIG. 1 is a top, plan view of a pump and valve unit conforming to the invention.
Figure 3:
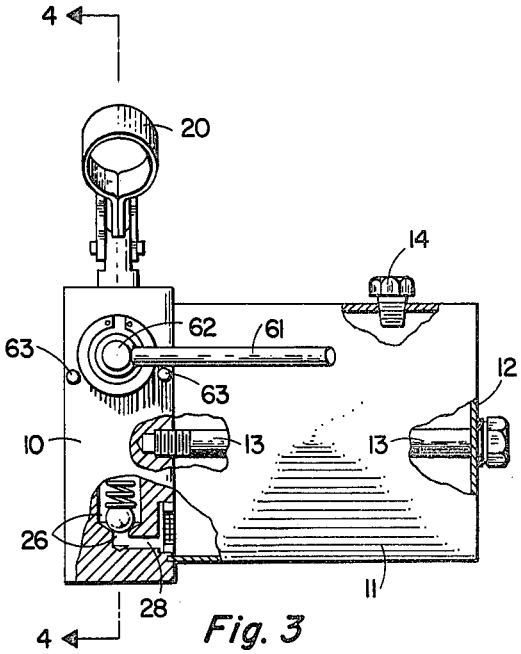
FIG. 3 is a front elevational view with portions of the unit broken away to show internal components.
Figure 2:
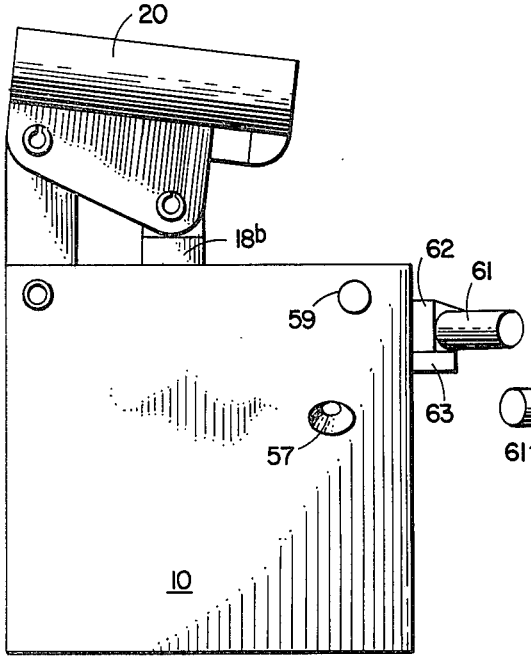
FIG. 2 is a side elevational view of the apparatus showing ports to which hydraulic tubing can be attached for outflow and inflow of hydraulic fluid to the unit.

The preferred embodiment of the unit in accordance with this invention and as illustrated in the drawings comprises a unitary block of material 10, such as steel, aluminum, or other applicable metal, in which a pump portion, valve portion and associated passageways are formed by simple machining techniques. A reservoir for hydraulic fluid is provided, as best shown in FIGS. 1 and 3 by a hollow cylindrical appendage 11 secured firmly to the side of the block 10. The cylindrical portion 11 has a closed end 12 (FIG. 3) and is advantageously secured to the block 10 by a bolt 13 extending from the end 12 to a threaded receptacle in the block 11. A removable plug 14 is provided in the cylindrical portion 11 for filling the hollow chamber therein with hydraulic fluid.

Figure 4:
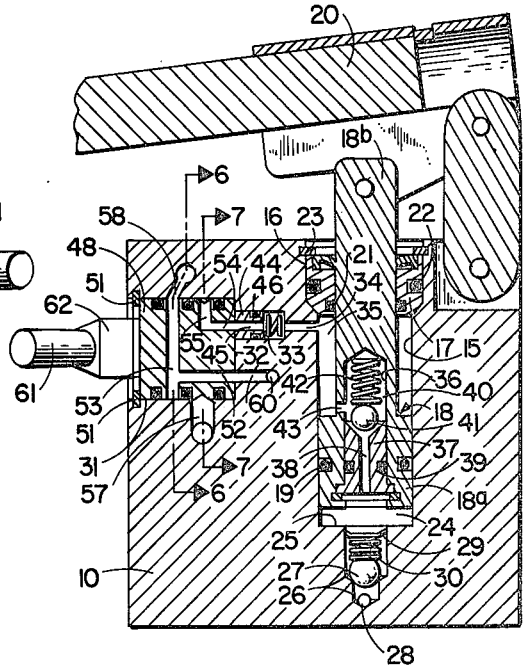
FIG. 4 is a vertical, sectional view taken on the line 4—4 of FIG. 3.

As illustrated in FIG. 4, the unitary block 10 includes a pump cylinder 15 which is readily bored into the block 10 from the top surface thereof. A counterbore 16 is conveniently provided at the upper portion of cylinder 15 for accommodating sealing means 17. A piston 18 is provided in the pump cylinder 15 and is adapted for manual reciprocation within the cylinder 15. The piston 18 has a head end portion **18*a* which makes a fluid-tight, sliding contact with the pump cylinder 15. As illustrated, the head end 18*a* of the cylinder makes close fitting, sliding contact with the cylinder sidewall, and in addition, the head end 18*a* is provided with an O-ring 19 positioned within an annular groove around the head end 18*a* of the piston. The piston is provided with an elongate portion 18*b* of a smaller cross-sectional area than that of the head end 18*a*. The elongate portion 18*b* extends from the head end 18*a* through the sealing means 17 and is attached to a pump handle mechanism 20. The sealing means 17 comprises an annular seal ring which fits tightly against the counterbore 16 and the piston extension 18*b*. To provide additional sealing, O-rings 21 and 22, respectively, are provided in annular grooves in the seal ring, with O-ring 21 sealing the seal ring and the piston extension 18, while O-ring 22 seals the sealing ring with the counterbore 16. The sealing means 17 is retained in the counterbore 16 by a retainer ring 23. A pump chamber 24 of varying volume is formed between the head end 18*a* of the piston 18 and the inner end 25 of pump cylinder 15**.

A flow passage is provided connecting the pump chamber 24 with the reservoir 11. As seen in FIGS. 3 and 4, the flow passage is conveniently formed by drilling a borehole 26 downwardly from the end 25 of pump cylinder 15. As illustrated, to accommodate check valve means, the borehole 26 has a reduced cross section intermediate its ends to form an abutment upon which the ball 27 of the check valve seats. A lateral borehole 28 is drilled from the side of the block 10 from the reservoir 11 into communication with the lower end of borehole 26. A spring 30 is held by a retainer 29 in the borehole 26 above the ball 27. The spring 30 biases the ball 27 into seating engagement with the abutment in borehole 26. The spring 30 and ball 27 form a check-valve which will allow hydraulic fluid to flow from the reservoir 11 to the pump chamber 24 but substantially prevents backflow of hydraulic fluid from the pump chamber 24 to the reservoir 11.

Figure 8:
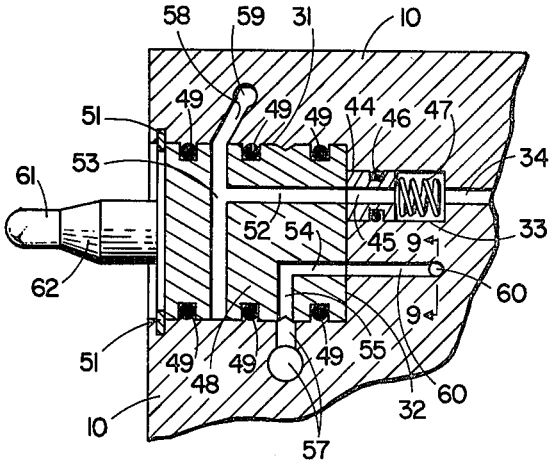
FIG. 8 is an enlarged partial vertical section of the valve spool portion of the apparatus taken on line 8—8 of FIG. 6.

As shown in FIGS. 4 and 8, a valve chamber is formed in the block 10 adjacent to the pump cylinder by drilling a borehole 31 inwardly from the side of the block 10. The inner end 32 of the borehole 31 is milled so as to be flat, and a valve intake chamber 33 is formed extending from the inner end 32 of valve chamber 31 inwardly toward the pump cylinder 15. The valve chamber 31 has a diameter of at least twice and preferably about 2.5 to 3.5 times the diameter of the valve intake chamber 33. The valve intake chamber 33 is easily formed by drilling a borehole of the proper diameter inwardly from the inner end 32 of valve chamber 31. The centerline or cylindrical axis of valve intake chamber 33 is offset from the center line or cylindrical axis of the valve chamber 31 by a distance at least equal to the radius of the valve intake chamber 33. Preferably, the cylindrical axis of the valve intake chamber 33 is offset from the cylindrical axis of the valve chamber 31 by a distance equal to about ½ the radius of the valve chamber 31.

A flow passage 34 (FIGS. 4 and 8) is drilled inwardly from the inner end of the valve intake chamber 33 to the pump cylinder. The flow passageway 34 is in flow communication with an annular channel 35 (FIG. 4) which is formed around the elongate portion **18*b* of piston 18. The head end 18*a* of the piston 18 is at one end of the annular channel 35 and the fluid-tight seal 17** forms the other end thereof.

A borehole 36 is drilled inwardly from the head end **18*a* of the piston into the elongate portion 18*b* thereof. Preferably, the borehole 36 is coaxial with the longitudinal axis of the piston 18. Check valve means are provided in the borehole 36 comprising a plug 37 having a central borehole 39 therethrough which is preferably coaxial with the longitudinal axis of the piston 18. The plug 37 can be provided with an annular groove which accommodates an O-ring 39 to insure a substantially fluid-tight seal between the plug 37 and the cylindrical wall of borehole 36. With plug 37 inserted into the open end of borehole 36, a chamber 40 is formed at the inner end of the borehole 36. The inner end of the plug 37 is adapted to form a seat for ball 41 which is positioned within the chamber 40, and a spring 42 biases the ball into engagement with the seat in the end of the plug 37. A passageway 43 is drilled in the lower end of the elongate portion 18***b* of piston 18. The passageway 43 provides flow communication between the chamber 40 and the annular channel 35. Thus, a composite passageway is provided from the pump chamber 24 to the valve intake chamber 33 comprising the borehole 38, chamber 40, passageway 43, annular channel 35 and passageway 34. The check valve means in borehole 36 of piston 18 allows fluid to flow from the pump chamber 24 to the valve intake chamber 33 as the piston 18 is moved in its downward stroke in pump cylinder 15 and prevents reverse flow of fluid from the valve intake chamber 33 to the pump chamber 24 during the upward stroke of piston 18.

A cylindrical thrust seal 44 (FIGS. 4 and 8) having a substantially axial borehole 45 extending therethrough is slidably mounted within the valve intake chamber 33. Sealing means, such as the annular groove in seal 44 and the O-ring 46 therein, provide for fluid-tight seal between the outer cylindrical wall of the thrust seal 44 and the cylindrical wall of the valve intake chamber 33. A spring 47 is positioned within the valve intake chamber 33 and biases the thrust seal 44 against the flat end of a valve spool 48 which is positioned within the valve chamber 31. The spring 47 applies sealing pressure against the thrust seal 44. During times when the fluid in the valve intake chamber 33 is relatively low, the spring 47 supplies the necessary sealing pressure against the thrust seal 44. As pressure is generated in the chamber 33, such pressure acts together with the spring 47 in developing the sealing pressure against the thrust seal 44. The spring 47, although preferred, is not an essential or critical item on the pump unit of this invention. By appropriate shaping of the thrust seal, such as by flaring the bore therein from the side thereof adjacent to the valve spool 48, sufficient sealing pressure is achieved by the pressure of the fluid in the valve chamber 31. During periods of relatively low pressure in the valve chamber 31, any leakage of fluid between the thrust seal and the valve spool is negligible and does no harm.

Figure 5:
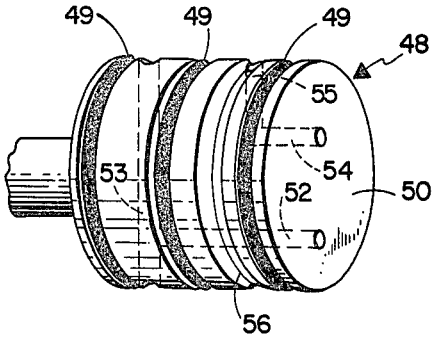
FIG. 5 is a perspective view of the valve spool as incorporated in the illustrated unit with flow passageways therein being shown by broken lines.

The valve spool 48 is shown removed from the unit and in perspective in FIG. 5. FIGS. 4 and 6–8 show the valve spool in its operative position within the valve chamber 31 of the apparatus of this invention. The valve spool 48 as shown in FIGS. 4, and 6–8, is rotatably mounted within the valve chamber 31 so that the cylindrical sidewall thereof and, in particular, the O-rings 49 make fluid-tight seal with the cylindrical side wall of valve chamber 31. The inner end 50 (FIG. 5) of valve spool 48 is flat and adapted to abut the flat inner end 32 (FIGS. 4 and 8) of valve chamber 31 and to make fluid tight seal with the end of thrust seal 44. The valve spool 48 is retained tightly against the end 32 of the valve chamber 31 by retainer ring 51 (FIGS. 4 and 8).

A pair of flow passages are provided in the valve spool 48, with the flow passages having mutually respective ports in the inner flat end 50 of the valve spool 48. The mutually respective ports are disposed equidistantly in diametrically opposite directions from the cylindrical axis of the valve spool 48, so that the ports can be brought into mutually alternating register with the borehole 45 in the thrust seal 44 by rotation of the valve spool 48. The flow passages in the valve spool 48 extend from the respective ports in the inner end 50 thereof to respective openings spaced longitudinally from each other in the cylindrical surface of the valve spool 48. As illustrated, one of the passages comprises a borehole 52 extending inwardly from the inner end 50 parallel with the cylindrical axis of the valve spool 48 to a depth of about $\frac{2}{3}$ the length of the valve spool 48. A companion borehole 53 is drilled diametrically through the valve spool 48, with the borehole 53 intersecting the inner end of borehole 52 so as to be in flow communication therewith. The other passage comprises a borehole 54 extending inwardly from the inner end 50 of the valve spool 48 to a depth of about $\frac{1}{3}$ the length of the valve spool 48. A companion borehole 55 is drilled from the cylindrical surface of the valve spool into flow communication with the inner end of borehole 54. An annular groove 56 (FIG. 5) extends around the surface of the valve spool 48 and intersects the opening from borehole 55, so that when the valve spool is positioned within the valve chamber 31, the passage comprising boreholes 54 and 55 is in flow communication with the annular groove 56.

Figure 6:
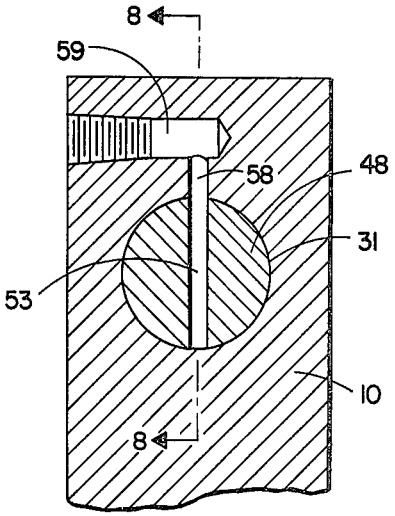
FIG. 6 is a partial elevational view taken on line 6—6 of FIG. 4.
Figure 7:
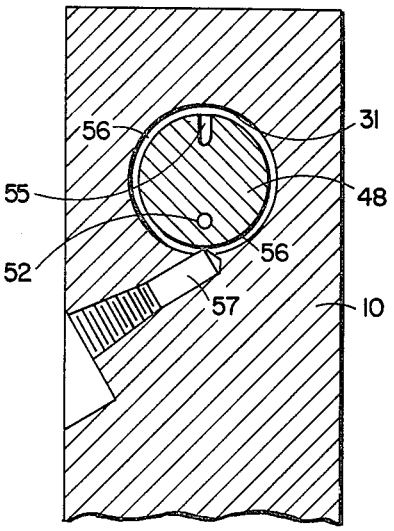
FIG. 7 is a partial elevational view taken on line 7—7 of FIG. 4.

A pair of passages 57 and 58, FIGS. 4, and 6–8, are provided in block 10 having respective, longitudinally spaced openings in the cylindrical wall of the valve chamber 31. These passages are adapted for selective registry with the respective openings in the cylindrical surface of the valve spool 48. As best illustrated in FIG. 7, the passage 57 is advantageously formed by drilling a borehole inwardly from the side of block 10 so that the end of the passage 57 registers with the groove 56 in the valve spool 48. As thus provided, the passageway comprising boreholes 54 and 55 in valve spool 48 is always in flow communication with the passage 57 in block 10, irrespective of what rotational position the valve spool 48 assumes. The opening of passage 57 in the side of block 10 is preferably tapped and threaded for connection to conventional hydraulic fluid tubing. The other passage 58 is advantageously drilled upwardly from the valve chamber 31 into the block 10. The passage 58 as shown in FIGS. 4 and 8 is readily formed using a drill bit which enters the open end of the valve chamber 31 with the valve spool 48 removed. Thus, the passage 58 is inclined towards the center of the block 10 due to the angle which the drill bit must assume during the boring of the borehole forming the passage 58. A cooperating passage 59 is drilled inwardly from the side of the block 10 as best shown in FIG. 6 in flow communication with the inner end of passage 58. The passage 59 is preferably tapped and threaded for connection to conventional hydraulic tubing. The passages 57 and 58 are adapted to accommodate outflow and return of hydraulic fluid from and to the unit as will be explained more fully hereinafter.

Figure 9:
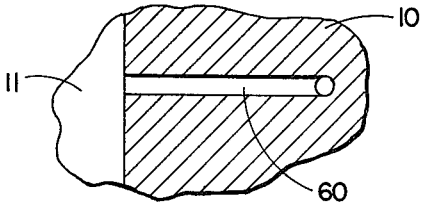
FIG. 9 is a partial vertical section taken on line 9—9 of FIG. 8.

A passage 60, FIGS. 4, 8 and 9, is adapted to return fluid from the valve chamber 31 to the reservoir 11. The passage 60 has a port opening into the flat end 32 of the valve chamber 31. The port is spaced from the center of the flat end 32 of valve chamber 31 in a diametrically opposite direction from the opening of the valve intake chamber 33. The port from passage 60 and the opening from valve intake chamber 33 are spaced equidistantly from the center of the flat end 32 of valve chamber 31, so that the respective ports in the flat end 50 of the valve spool 48 are adapted to be brought into mutually alternating register with the port from passage 60 and the opening from the valve intake chamber by rotation of the valve spool 48 about its cylindrical axis.

Means are provided for rotating the valve spool 48. As illustrated, a handle 61 is attached through a hub 62 to the valve spool 48. To facilitate the 180° rotational movement of the valve spool 48, a pair of stops 63 are provided extending from the body 10 of the pump and valve unit, so that the valve spool 48 is conveniently moved between its two alternative positions by moving the handle 61 from one position abutting one of the stops 63 to the other position abutting the other stop 63 and vice-versa.

The pump and valve device of this invention is useful in a hydraulic system wherein hydraulic fluid is selectively applied to the opposite sides of a cylinder to control direction and movement of a piston in the cylinder. Such a hydraulic system is useful in remote control operations of switches, latches, etc. The device of the present invention is particularly adapted for use with hydraulic systems designed for tilting truck cabs.

In operation, when the pump handle 20 is raised, thereby raising piston 18 in cylinder 15, hydraulic fluid is drawn from reservoir 11 through the flow passage comprising boreholes 28 and 26, past ball 27 into the pump chamber 24. When the pump handle 19 is pushed downwardly, thereby forcing piston 18 to descend in cylinder 15, the ball 27 seats on the abutment in borehole 26 preventing flow of hydraulic fluid from the pump chamber 24 back to the reservoir 11. Instead, the hydraulic fluid is forced through borehole 38, past ball 41, through passages 43, 35 and 34 to the valve intake chamber 33. The ball 41 prevents backflow of hydraulic fluid back to the pump chamber 24 during the next upstroke of piston 18. The pump mechanism shown in the drawings is double acting, i.e., fluid is pumped during both the upward and downward strokes of the pump handle 20. As the pump handle is raised, fluid is forced from passage 34 at the same time fluid is drawn through the intake check valve 27 to chamber 24. Fluid is forced from chamber 24 and passage 34 during the downward stroke of handle 20.

With the valve spool 48 in the position shown in FIG. 4, the hydraulic fluid is forced by the pressure developed by piston 18 through the opening 45 in the thrust seal 44 in valve inlet chamber 33 and into the passageway comprising boreholes 54 and 55 in the valve spool 48. The hydraulic fluid then flows from the passageway in the valve spool 48, through the passage 57 to one end of a working cylinder (not shown) of the hydraulic system which is being served. The fluid in the opposite end of the working cylinder flows back to the pump and valve unit of this invention through passages 59 and 58 which are in communication with the borehole 53 in the valve spool 48. The return fluid then flows through borehole 52 in the valve spool 48 and borehole 60 in the block 10 back to the reservoir 11. Borehole 60 is adapted to meter or otherwise limit the rate of fluid return therethrough to the reservoir 11. This can be done by providing a metering orifice in the borehole 60, or appropriately sizing borehole 60 to provide the necessary metering effect.

The supply of pressurized hydraulic fluid produced by the pump portion of the present unit can be readily changed from the one end of the working cylinder to the other end thereof, thereby operating the piston of the working cylinder in the opposite direction, by rotating the valve spool 48 through ½ turn, i.e., by 180°, to its position shown in FIG. 8. The pump portion is now connected through the valve intake chamber 33, boreholes 52 and 53 of valve spool 48, and passages 58 and 59 in the block 10 of the unit of this invention to the opposite end of the working cylinder of the hydraulic system being served. The pressurized hydraulic fluid now forces the piston in the working cylinder in the opposite direction, and return fluid from the working cylinder flows through passage 57 in the block 10, passages 55 and 54 in the valve spool 48, and borehole 60 back to the reservoir 11.

The working cylinder of the hydraulic unit being served can be isolated from the pump portion of the present unit at any point in its travel by rotating the valve spool 48 to a neutral position, i.e., when the handle 61 is positioned intermediate the stops 63. In such a position, hydraulic fluid cannot flow to or return from the working cylinder, and the piston of the cylinder will be held steady in the position attained at the time when the valve spool 48 was rotated to the netural position.

A particular advantage of the present invention is that the unitary body 10 can be made of a relatively soft and easily machined material such as aluminum and unhardened steels instead of abrasion resistant materials such as hardened steels and alloys.

Whereas this invention is specifically illustrated and described with an embodiment that represents the best mode presently contemplated of carrying out the invention, it should be understood that other embodiments and various modifications can be achieved in accordance with the teachings hereof without departing from the subject matter coming within the scope of the accompanying claims, which subject matter is regarded as the invention.

I claim:

1. A hydraulic pump and valve unit comprising a unitary block having a hydraulic fluid reservoir appended to one side of the block;

a first cylindrical bore drilled into said block extending inwardly from one end wall thereof;

a first flow passage bored into said block from said hydraulic fluid reservoir, said first flow passage communicating from the inner end of said first cylindrical bore to said hydraulic fluid reservoir;

a pump piston adapted for reciprocal movement in said first cylindrical bore so as to form a pump chamber between the piston and the inner end of said first cylindrical bore;

means for moving said piston in its reciprocal movement;

first check valve means which allows hydraulic fluid to flow from the reservoir to the pump chamber but substantially prevents backflow of the hydraulic fluid from the pump chamber to the reservoir;

a second cylindrical bore drilled into said block extending inwardly from a second end wall so as to be generally perpendicular to said first cylindrical bore, with the inner end of the second cylindrical bore being milled so as to be flat;

a third cylindrical bore drilled into said block extending from the flat, milled, inner end of said second cylindrical bore toward the first cylindrical bore, said third cylindrical bore having a diameter no greater than one-half the diameter of the second cylindrical bore, with the cylindrical axis of said third cylindrical bore being offset from the cylindrical axis of said second cylindrical bore;

a second flow passage bored inwardly from the inner end of said third cylindrical bore so as to connect said third cylindrical bore with said first cylindrical bore;

a third flow passage associated with said piston and adapted to connect said second flow passage to said pump chamber;

second check valve means which allows hydraulic fluid to flow from said pump chamber through said third flow passage to said second flow passage, but substantially prevents backflow of the hydraulic fluid from said second flow passage to said pump chamber;

a cylindrical thrust seal having a substantially axial borehole extending therethrough and being slidably mounted in said third cylindrical bore, said seal including sealing means between the outer cylindrical wall of the thrust seal and the cylindrical wall of said third cylindrical bore;

a fourth flow passage bored inwardly from the inner end of said second cylindrical bore so as to connect said second cylindrical bore with said reservoir;

a cylindrically-shaped valve spool rotatably mounted in said second cylindrical bore, said valve spool having an essentially flat inner end adapted to abut the flat end of said second cylindrical bore;

means for rotating the valve spool;

fifth and sixth flow passages in said valve spool having mutually respective ports disposed on the flat, inner end of said valve spool so that the ports can be brought into mutually alternating register with said third cylindrical bore and said fourth flow passage, respectively, in the inner end of said second cylindrical opening by rotation of said valve spool, said fifth and sixth flow passages extending through said valve spool from said ports in the end of the valve spool to mutually respective openings in the cylindrical side of said valve spool, so that said fifth and sixth flow passages extend solely between the cylindrical side and the inner, flat end of said valve spool, with the outer end of the valve spool being externally open to the exterior of the unitary block and connected to the means for rotating the valve spool and;

seventh and eighth flow passages bored inwardly from the side of said block so as to have respective spaced openings into said second cylindrical bore which are adapted to register with the respective openings in said valve spool, said seventh and eighth flow passages being adapted to direct the outflow and return of hydraulic fluid from and to the pump and valve unit.

2. A hydraulic pump and valve unit in accordance with claim 1 wherein said fourth flow passage opens into the flat end of said second cylindrical bore so that the openings from the third cylindrical bore and the fourth flow passage are spaced equidistantly in diametrically opposite directions from the center of the flat end of said second cylindrical bore, and said parts in the fifth and sixth flow passages are disposed in the flat end of said valve spool equidistantly in diametrically opposite directions from the cylindrical axis of the valve spool.

3. A hydraulic pump and valve unit in accordance with claim 1, wherein the pump piston has a head end portion which makes fluid-tight, sliding contact with the cylindrical side wall of said first cylindrical bore and an elongate portion of a smaller cross sectional area than that of the head end portion, said elongate portion extending through a fluid-tight seal at the outer end of said first cylindrical bore, with the end thereof being attached to said means for imparting reciprocal motion to said pump piston; said third flow passage comprises a flow channel extending through the head end portion of the piston from said pump chamber to an annular channel formed around the elongate portion of the piston and the fluid-tight seal at said outer end of said first cylindrical bore, with said second flow passage opening into said annular chamber adjacent to the fluid-tight seal at said outer end of said first cylindrical bore; said first check valve means is in said first flow passage; and said second check valve means is in said flow channel extending through the head end of the piston.

4. A hydraulic pump and valve unit in accordance with claim 1, wherein said first check valve means is positioned in said first flow passage, and said second check valve means is positioned in said third flow passage.

5. A hydraulic pump and valve unit in accordance with claim 1, wherein spring means is provided in said third cylindrical bore biasing the cylindrical thust seal therein against the valve spool to make a sliding, seal therebetween.

* * * * *